US007240512B2

(12) United States Patent
Lee et al.

(10) Patent No.: US 7,240,512 B2
(45) Date of Patent: Jul. 10, 2007

(54) REFRIGERATOR AND COOLING AIR PASSAGE STRUCTURE THEREOF

(75) Inventors: Wook Yong Lee, Gwangmyeong-si (KR); Eui Yeop Chung, Seoul (KR); Seung Hwan Oh, Goonpo-si (KR); Myung Ryul Lee, Seongnam-si (KR); Ill Shin Kim, Changwon-si (KR); Seong Ook Kim, Jinjoo-si (KR); Yong Chol Kwon, Changwon-si (KR)

(73) Assignee: LG Electronics Inc., Seoul (KR)

( * ) Notice: Subject to any disclaimer, the term of this patent is extended or adjusted under 35 U.S.C. 154(b) by 126 days.

(21) Appl. No.: 11/043,972

(22) Filed: Jan. 28, 2005

(65) Prior Publication Data

US 2005/0178145 A1 Aug. 18, 2005

(30) Foreign Application Priority Data

Jan. 28, 2004 (KR) ..... 10-2004-0005380

(51) Int. Cl.
*F25C 1/12* (2006.01)

(52) U.S. Cl. ..... 62/353; 62/426

(58) Field of Classification Search ..... 62/66–74, 62/340–356, 414, 419, 426
See application file for complete search history.

(56) References Cited

U.S. PATENT DOCUMENTS 3,788,089 A 1/1974 Graves
4,003,214 A 1/1977 Schumacher
4,872,317 A 10/1989 Reed
5,211,462 A 5/1993 Bien et al.
5,375,432 A 12/1994 Cur
6,442,954 B1 9/2002 Shapiro et al.
6,735,959 B1 * 5/2004 Najewicz ..... 62/3.63
6,945,068 B2 9/2005 Kim et al.
7,076,967 B2 * 7/2006 Lee et al. ..... 62/353
2004/0237565 A1 12/2004 Lee et al.
2005/0061016 A1 3/2005 Lee et al.

FOREIGN PATENT DOCUMENTS

JP 06 011228 A 1/1994
JP 2000-065458 A 3/2000

* cited by examiner

*Primary Examiner*—William E. Tapolcai
(74) *Attorney, Agent, or Firm*—Birch, Stewart, Kolasch & Birch, LLP

(57) ABSTRACT

Provided is a refrigerator including an adiabatic space formed on an inner surface of a chilling chamber door and an ice machine disposed inside the adiabatic space, thereby enabling a more efficient usage of an inner space of the refrigerator. Also, the present invention provides a cooling air passage structure of a refrigerator for properly supplying cooling air for freezing to an inside of the refrigerator having an ice machine disposed on an inner surface of a chilling chamber door.

20 Claims, 6 Drawing Sheets

REFRIGERATOR AND COOLING AIR PASSAGE STRUCTURE THEREOF

BACKGROUND OF THE INVENTION

1. Field of the Invention

The present invention relates to a refrigerator, and more particularly, to a passage structure of cooling air fed to an ice machine installed in a refrigerator. Further, the invention relates to a side-by-side type refrigerator enabling inflow and outflow of cooling air to an ice machine installed in the refrigerator, and a cooling air passage structure thereof.

2. Description of the Related Art

Generally, a refrigerator is a machine to keep foods fresh for a predetermined time or freeze foods by lowering inner temperature thereof while refrigerant repeats a cooling cycle including compression, condensation, expansion and evaporation, and is one of life's necessities.

At the present, the refrigerator shows a tendency to increase its volume, and various types of refrigerators such as a side-by-side type refrigerator having two doors are developed so as to meet consumers' demands. Such a two door refrigerator includes a freezing chamber and a chilling chamber and further includes an ice machine for freezing water to manufacture ice and extracting and receiving the manufactured ice.

The ice machine includes an icemaker where ice is manufactured, an ice bank for storing the ice manufactured in the ice machine, an ice crusher for crushing the ice received in the ice bank and transferred thereinto, and ice dispenser for directly providing a user with the crushed ice. The ice machine is generally built in the freezing chamber of the refrigerator.

The ice machine built in the freezing chamber of the refrigerator, however, occupies too much space in the freezing chamber. Thus, since the ice machine is installed at the door of the freezing chamber, consumers who use the receiving space of the freezing chamber frequently have inconvenience.

Also, in the general side-by-side type refrigerator, since the freezing chamber is made smaller than the chilling chamber, the aforementioned inconvenience is conspicuous.

SUMMARY OF THE INVENTION

Accordingly, the present invention is directed to a refrigerator and a cooling air passage structure thereof that substantially obviate one or more problems due to limitations and disadvantages of the related art.

An object of the present invention is to provide a refrigerator and a cooling air passage structure thereof in which an ice machine is installed in a chilling chamber and a cooling air passage for inflow of cooling air into and outflow from the ice machine is provided.

Another object of the present invention is to provide a refrigerator and a cooling air passage structure thereof in which an ice machine is installed at a door of a chilling room to use the inner space of the chilling chamber more efficiently.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a refrigerator comprising: a freezing chamber for storing a product at a temperature below zero; a chilling chamber for storing a product at a temperature above zero; a freezing chamber door for opening and closing an entrance of the freezing chamber; a chilling chamber door for opening and closing an entrance of the chilling chamber; a barrier for partitioning an inner space of the refrigerator into the freezing chamber and the chilling chamber; an adiabatic case formed at an inner portion of the chilling chamber door; an ice machine received in the adiabatic case; and a cooling air supply duct formed at an inside of the barrier and having one end through which a low temperature air is introduced and the other end communicating with an inner space of the adiabatic case.

In another aspect of the present invention, there is provided a cooling air passage structure of a refrigerator, comprising: an adiabatic space formed inside a door of a chilling chamber; an ice machine disposed inside the adiabatic space; and a refrigerator wall having a first air passage for supplying a cooling air for water freezing to the ice machine.

In a further aspect of the present invention, there is provided a refrigerator comprising: a freezing chamber for storing a product at a temperature below zero; a chilling chamber for storing a product at a temperature above zero; a freezing chamber door for opening and closing an entrance of the freezing chamber; a chilling chamber door for opening and closing an entrance of the chilling chamber; a chilling chamber wall and a freezing chamber wall each including therein an adiabatic member; an evaporator for generating a cooling air having a temperature below zero using evaporation of refrigerant; an adiabatic case formed at an inner portion of the chilling chamber door; an ice machine installed in the adiabatic case; and a pair of air passages disposed inside an outer wall of the refrigerator, each of the pair of air passages having one end communicating with an inside of the adiabatic case and the other end communicating with an installation space of the evaporator.

According to the proposed present invention, it is advantageous that the inner space of each of the freezing chamber and the chilling chamber can be increased and the supply of cooling air toward the ice machine can be more smoothly performed.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

Figure 1:
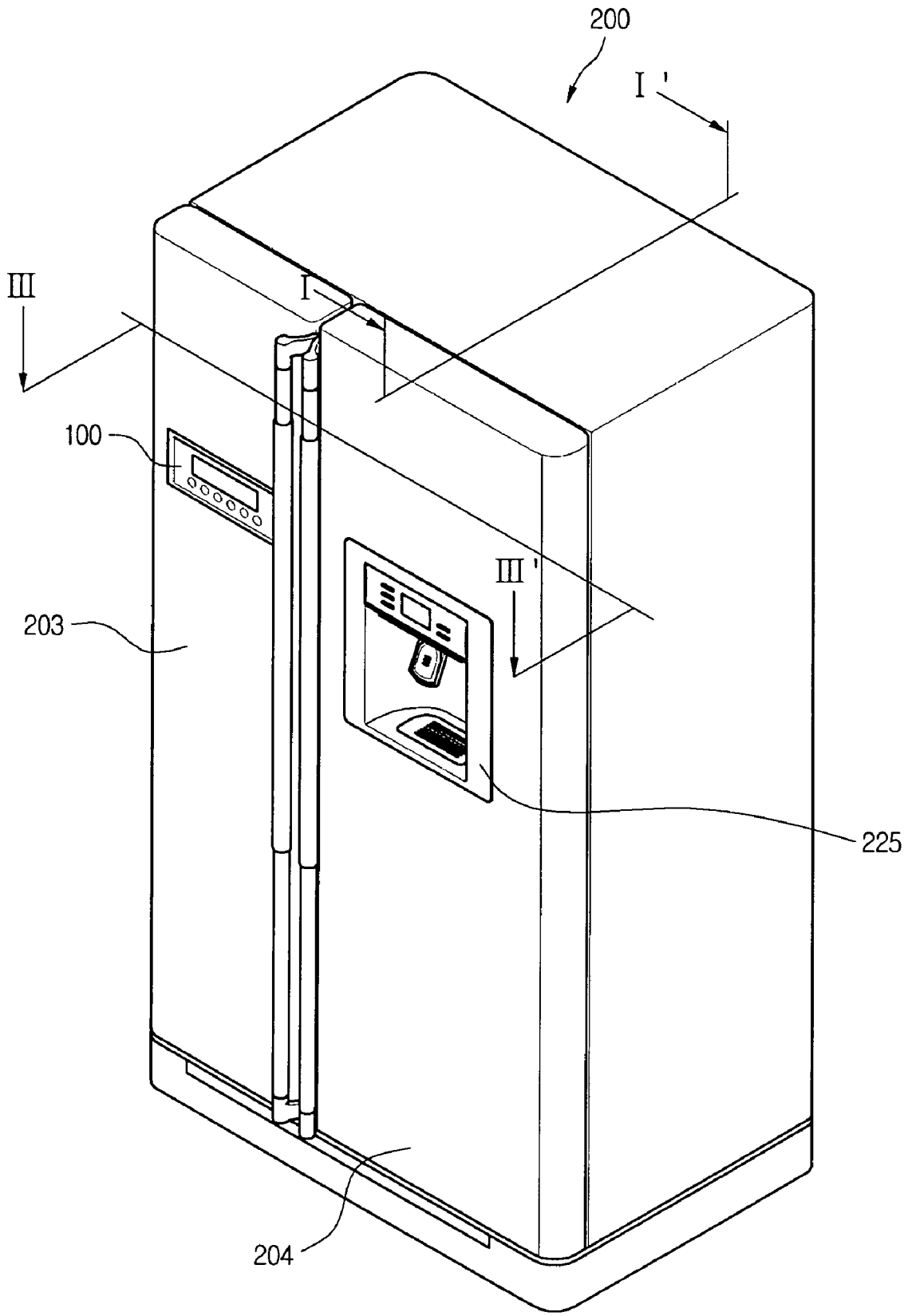
FIG. 1 is a perspective view of a refrigerator according to a first embodiment of the present invention.
Figure 2:
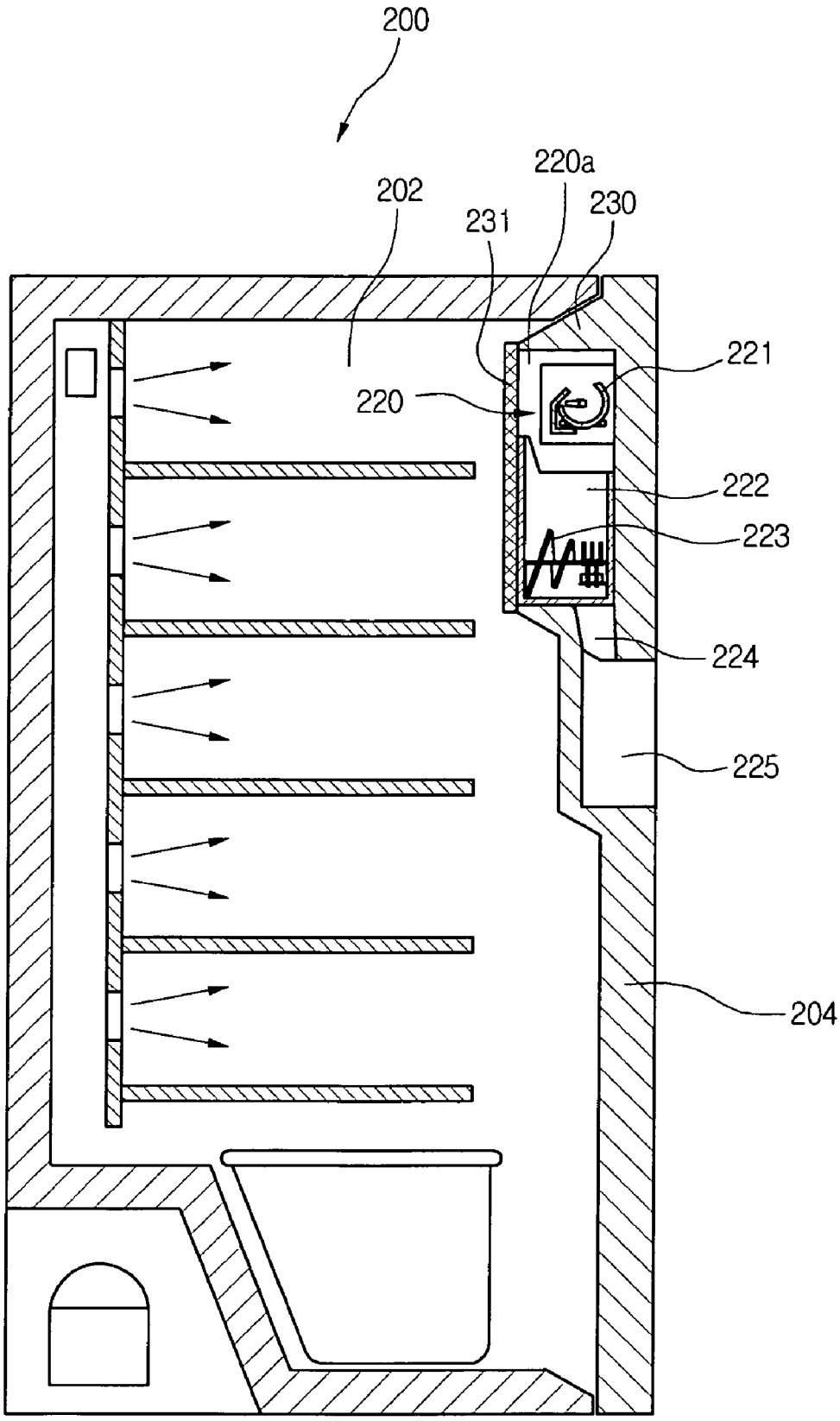
FIG. 2 is a sectional view taken along the line I-I' of FIG. 1.
Figure 3:
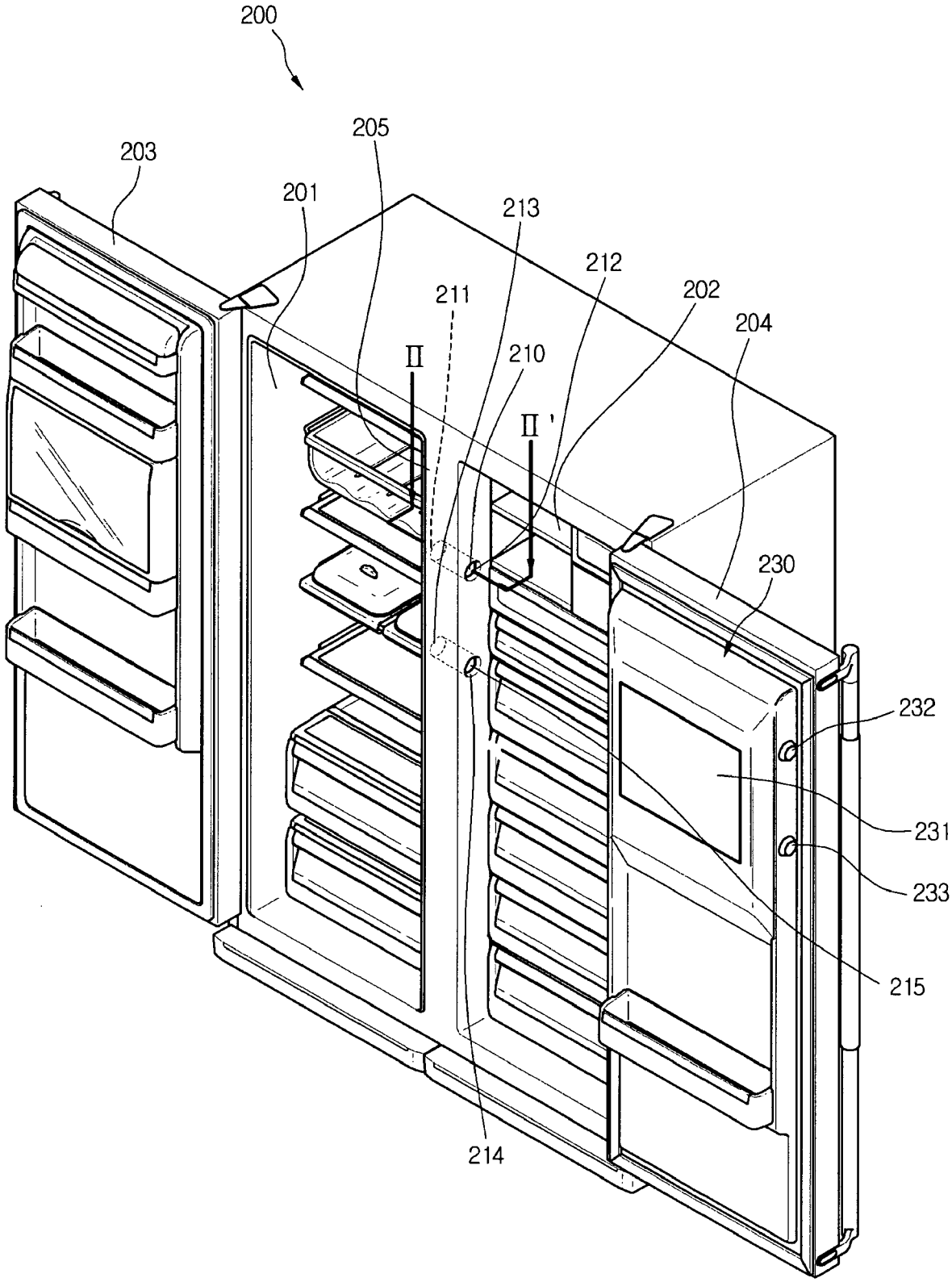
FIG. 3 is a perspective view of a refrigerator of which door is opened according to the present invention.

FIG. 1 is a perspective view of a refrigerator according to a first embodiment of the present invention, FIG. 2 is a sectional view taken along the line I-I' of FIG. 1, and FIG. 3 is a perspective view of a refrigerator of which door is opened according to the present invention.

Referring to FIGS. 1 through 3, the side-by-side type refrigerator 200 includes a freezing chamber 201 for storing products in a frozen state, a chilling chamber 202 for storing products in a chilled state, and a barrier 205 for partitioning an inner space of the refrigerator 200 into the freezing chamber 201 of the left and the chilling chamber 202 of the right. The refrigerator 200 also includes a freezing chamber door 203 disposed at a front side of the freezing chamber 201, for opening and closing the freezing chamber 201 and a chilling chamber door 204 disposed at a front side of the chilling chamber 202, for opening and closing the chilling chamber 202.

In addition, a manipulation part 100 is formed on an outer surface of the freezing chamber door 203 to control the operation of the refrigerator 200. An ice dispenser 225 for dispensing ice is formed at an outer surface of the chilling chamber door 204 such that the manufactured ice is fed to the ice dispenser by a predetermined amount. To feed a proper amount of ice through the ice dispenser 225, an ice machine 220 is installed at a predetermined height of an inner portion of the chilling chamber door 204.

The ice machine 220 is essentially provided with an icemaker 221 where ice is manufactured, and an ice bank 222 for storing the manufactured ice. The ice machine is installed inside an adiabatic case 230. Specifically, the ice machine 220 is installed at an adiabatic space 220*a* defined by the adiabatic case 230 disposed inside the chilling chamber door 204. The adiabatic space 220*a* is adiabatically isolated from the chilling chamber 202 by an adiabatic cover 231.

In detail, the ice machine 220 includes the icemaker 221 and the ice bank 222. The icemaker 221 is installed at an upper portion of the adiabatic space 220*a* to freeze fed water using cooling air for the freezing, thereby manufacturing ice. The ice bank 222 is installed at a lower portion of the adiabatic space 220*a* to store the ice extracted from the icemaker 221. Also, the ice machine 220 includes an auger 223 for transferring and crushing the ice received in the ice bank 222 and an ice discharge hole 224 for discharging the ice received in the ice bank 222. The ice dispenser 225 from which a user extracts the ice received in the ice bank 222 is installed at the outer surface of the chilling chamber door 204.

The adiabatic case 230 is installed inside the chilling chamber door 204 and has the openable and closable adiabatic cover 231 formed at one-sided portion thereof. To maintain a constant inner temperature, the adiabatic case 230 has an outer surface, which is coated with a material for reducing heat loss to or heat inflow from an outside. For example, the outer surface of the adiabatic case 230 is coated with polyurethane film.

Meanwhile, in order for the ice machine 220 installed at the chilling chamber door 204 to perform a freezing operation, cooling air generated in an evaporator should be supplied as a cooling air for the freezing. It is preferable that the freezing air has a temperature below zero that the ice is not melted. The temperature of the cooling air for the freezing is set to be nearly the same as that of the cooling air of the freezing chamber. The present invention is characterized by providing a cooling air passage allowing the cooling air for the freezing to be properly supplied to the ice machine 220.

Figure 5:
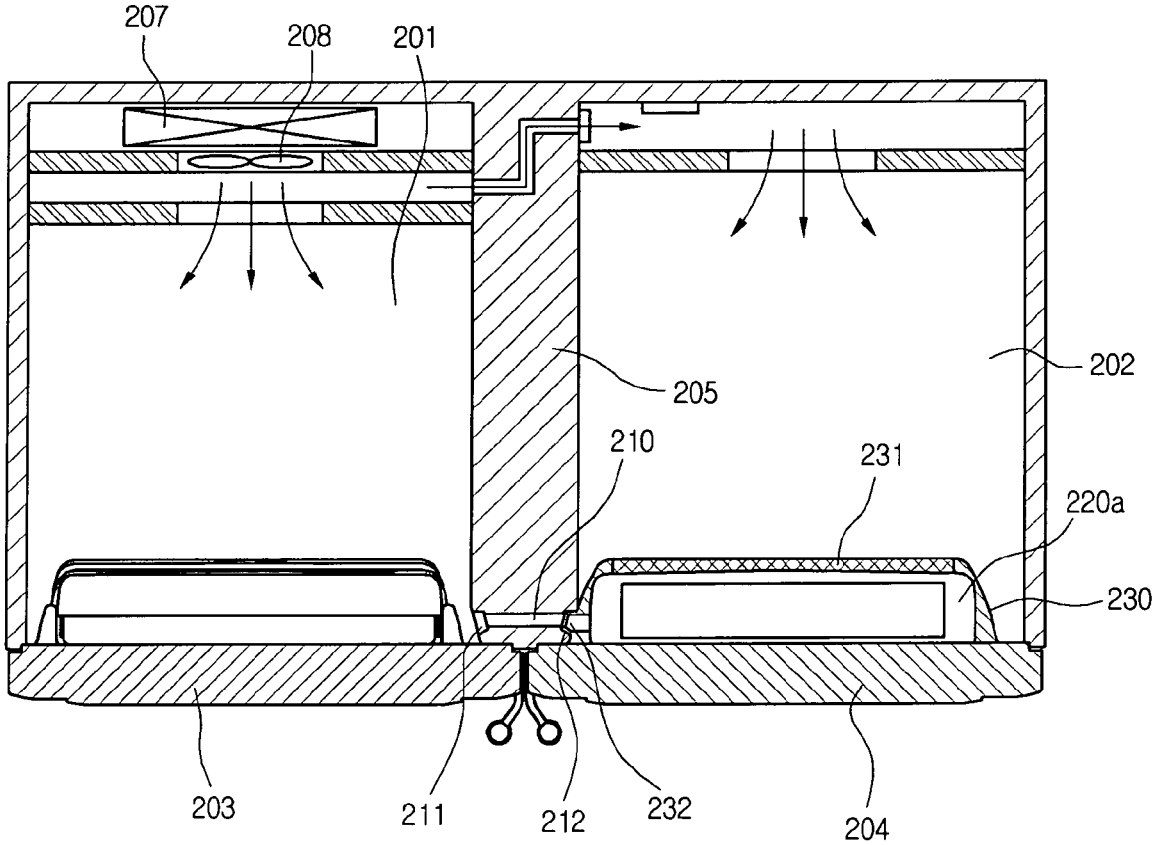
FIG. 5 is a sectional view taken along the line III-III' of FIG. 1.

FIG. 5 is a sectional view taken along the line III-III' of FIG. 1 and shows a cooling air passage structure for the freezing.

Referring to FIGS. 3 and 5, cooling air generated by an evaporator 207 and a blower fan 208 installed at a rear wall of the refrigerator is supplied to the ice machine 220 installed in the chilling chamber door 204 via the freezing chamber 201 and the barrier 205. The freezing air supplied to the ice machine 220 is again circulated to the freezing chamber 201.

In other words, the cooling air of the freezing chamber 201 is introduced via the barrier 205 and the adiabatic case 230 into the adiabatic space 220*a* where the ice machine 220 is positioned. The cooling air used for the freezing in the ice machine 220 is again discharged to the freezing chamber 201 through the adiabatic case 230 and the barrier 205. By the flow of the cooling air, the cooling air passage structure is defined.

The cooling air passage structure will now be described in detail.

First, a cooling air supply duct 210 is formed inside the barrier 205 partitioning the inner space of the refrigerator into the left freezing chamber 201 and the right chilling chamber 202. One end of the cooling air supply duct 210 communicates with an inner space of the freezing chamber 210 to form a first cooling air inlet 211 and the other end of the cooling air supply duct 210 contacts the adiabatic case 230 to form a first cooling air outlet 212. Like the cooling air supply duct 210, a cooling air discharge duct 215 is also formed at an inner space of the barrier 205. One end of the cooling air discharge duct 215 communicates with an inner space of the freezing chamber 210 to form a third cooling air outlet 213 and the other end of the cooling air discharge duct 215 contacts the adiabatic case 230 to form a third cooling air inlet 214.

Also, a second cooling air inlet 232 is formed at a predetermined portion of a side surface of the adiabatic case 230 corresponding to the first cooling air outlet 212, and a second cooling air outlet 233 is formed at a predetermined portion of the side surface of the adiabatic case 230 corresponding to the third cooling air inlet 213.

The ice machine 220, i.e., flow of cooling air supplied to the adiabatic space 220*a*, will now be described with reference to the above cooling air passage structure.

The cooling air of the freezing chamber 201 is introduced into the first cooling air inlet 211, flows through an inside of the cooling air supply duct 210, and is then exhausted through the first cooling air outlet 212. Then, the cooling air is introduced into the second cooling air inlet 232 of the adiabatic case 230 closely contacting the first cooling air outlet 212 and is used as the freezing air in the ice machine 220.

After that, the cooling air used for the freezing is exhausted through the second cooling air outlet 233 of the adiabatic case 230, is then introduced into the third cooling air inlet 213 formed in the barrier 205, and flows through the inside of the cooling air discharge duct 215. Thereafter, the cooling air flowing through the inside of the cooling air discharge duct 215 is discharged to an inside of the freezing chamber 201 through the third cooling air outlet 214.

The cooling air supply duct 210 is formed in the barrier to communicate the freezing chamber 201 with the chilling chamber 202. In other words, the cooling air of the freezing chamber 201 flows through the cooling air supply duct 210 of the barrier 205, is introduced into the inside of the adiabatic case 230, and is then supplied to the ice machine 220 disposed inside the adiabatic space 220*a*. Thus, the passage used for introducing the cooling air into the ice machine 220 is referred to as 'a first cooling air introduction passage'.

The cooling air used for the freezing by the ice machine 220 is introduced into the third cooling air inlet 213 through the second cooling air outlet 233 of the adiabatic case 230, flows through the cooling air discharge duct 215, and is then discharged into the freezing chamber 201. Thus, the passage used for discharging the cooling air of the ice machine 220 is referred to as 'a first cooling air discharge passage'.

Accordingly, the icemaker 221 of the ice machine 220 freezes the water fed thereinto using the cooling air introduced through the barrier 205 and the cooling air inlet 232 of the adiabatic case 230 to manufacture ice. The manufactured ice drops into and is received in the ice bank 22.

The ice received in the ice bank 22 can be supplied to an outside of the refrigerator through the ice dispenser 225 if necessary.

In a modification, it is possible not to recycle the cooling air supplied through the first cooling air introduction passage and used for the freezing in the ice machine 220 to the freezing chamber 201 but to directly discharge the cooling air to the chilling chamber 202. For this purpose, it is possible to form a cooling air discharge hole (now shown) at a lower portion of the adiabatic case 230 such that the cooling air used in the ice machine 220 is discharged to the chilling chamber 202 through the cooling air discharge hole of the adiabatic case 230. This cooling air discharge passage is discriminated from the first cooling air discharge passage and accordingly referred to as 'a second cooling air discharge passage'.

In other words, in a second cooling air circulation passage connecting the first cooling air introduction passage and the second cooling air discharge passage, the cooling air of the freezing chamber is introduced into the adiabatic space 220*a* where the ice machine 220 is installed, through the barrier 205 and the adiabatic case 230 and the cooling air of the adiabatic space 220*a* is introduced into the chilling chamber 202. The cooling air introduced into the chilling chamber 202 is supplied to the evaporator along a return path formed at the chilling chamber 202 to perform heat exchange using the evaporator and a blower fan, and the heat-exchanged cooling air can be again introduced into the chilling chamber 202.

Figure 4:
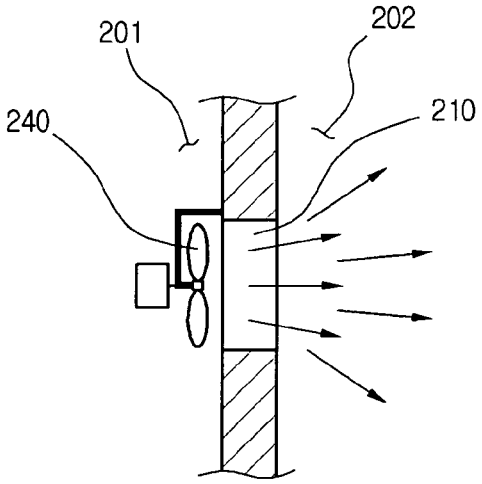
FIG. 4 is a sectional view taken along the line II-II' of FIG. 3.

As will be seen from the sectional view of FIG. 4 taken along the line II-II' of FIG. 3, a blower fan 240 may be further provided in the cooling air supply duct 210 to increase and control the amount of the cooling air flowing into the ice machine 220. The blower fan 240 is operable when the temperature of the cooling air supplied to the ice machine 220 is not sufficiently low or the supply amount of the cooling air is small. This case occurs when the cooling load of the ice machine is high or a large amount of cooling air is discharged through the first and second cooling air discharge passages.

Specifically, the blower fan 240 is installed at the front side of the first cooling air inlet 211 such that the cooling air of the freezing chamber 201 is easily discharged through the cooling air supply duct 210 of the barrier 205. As the blower fan 240 is rotated by a motor, the amount of the cooling air of the freezing chamber 201 flowing through the cooling air circulation passage increases, so that the amount of the cooling air for the freezing flowing through the cooling air introduction passage and the cooling air discharge passage increases and the circulation period of the cooling air is shortened to enhance the freezing efficiency of the ice machine 220.

In another modification, the blower fan 240 may be installed at an inlet end of the adiabatic case 230. Alternatively, the blower fan 240 may be installed at an outlet end of the adiabatic case 230 or inside the cooling air supply duct 210 or the cooling air discharge duct 215. If the blower fan 240 is installed inside the cooling air supply duct 210 or the cooling air discharge duct 215, interference between outer parts does not occur and a graceful appearance can be obtained.

Also, the blower fan 240 may be installed at two or more places. In other words, it is preferable that the blower fan 240 is installed on the cooling air introduction passage and the cooling air discharge passage at least one. In addition, the blower fan 240 is driven when the temperature of the cooling air supplied to the adiabatic space 220*a* is not sufficiently low, it is possible to enhance the freezing efficiency of the ice machine 220.

In the meanwhile, a packing member, which is closely in contact with the chilling chamber door 204 when the chilling chamber door 204 is opened or closed, is installed at a contact surface between the first cooling air outlet 212 of the barrier 205 and the second cooling air inlet 232 of the adiabatic case 230 at a contact surface between the third cooling air outlet 213 of the barrier 205 and the second cooling air outlet 233 of the adiabatic case 230.

The packing member is made in a facing unevenness shape. That is, as shown in FIG. 5, the first cooling air outlet 212 and the third cooling air inlet 213 are made in a groove shape and the second cooling air inlet 232 and the second cooling air outlet 233 are made in a protrusion shape. The groove of the first cooling air outlet 212 and the third cooling air inlet 213 is engaged with the protrusion of the second cooling air inlet 232 and the second cooling air outlet 233 to form the unevenness shape, so that the first cooling air outlet 212 and the third cooling air inlet 213 are closely in contact with the second cooling air inlet 232 and the second cooling air outlet 233. In addition, a sealing member such as a rubber or a gasket may be further formed around the unevenness shape.

Accordingly, it is advantageous that the cooling air is not leaked through each contact between the adiabatic case 230 and the barrier 205.

Second Embodiment

The second embodiment of the present invention is characteristically different than the first embodiment in that cooling air having a temperature below zero is not via the freezing chamber but is directly supplied from the evaporator to the ice machine.

Figure 6:
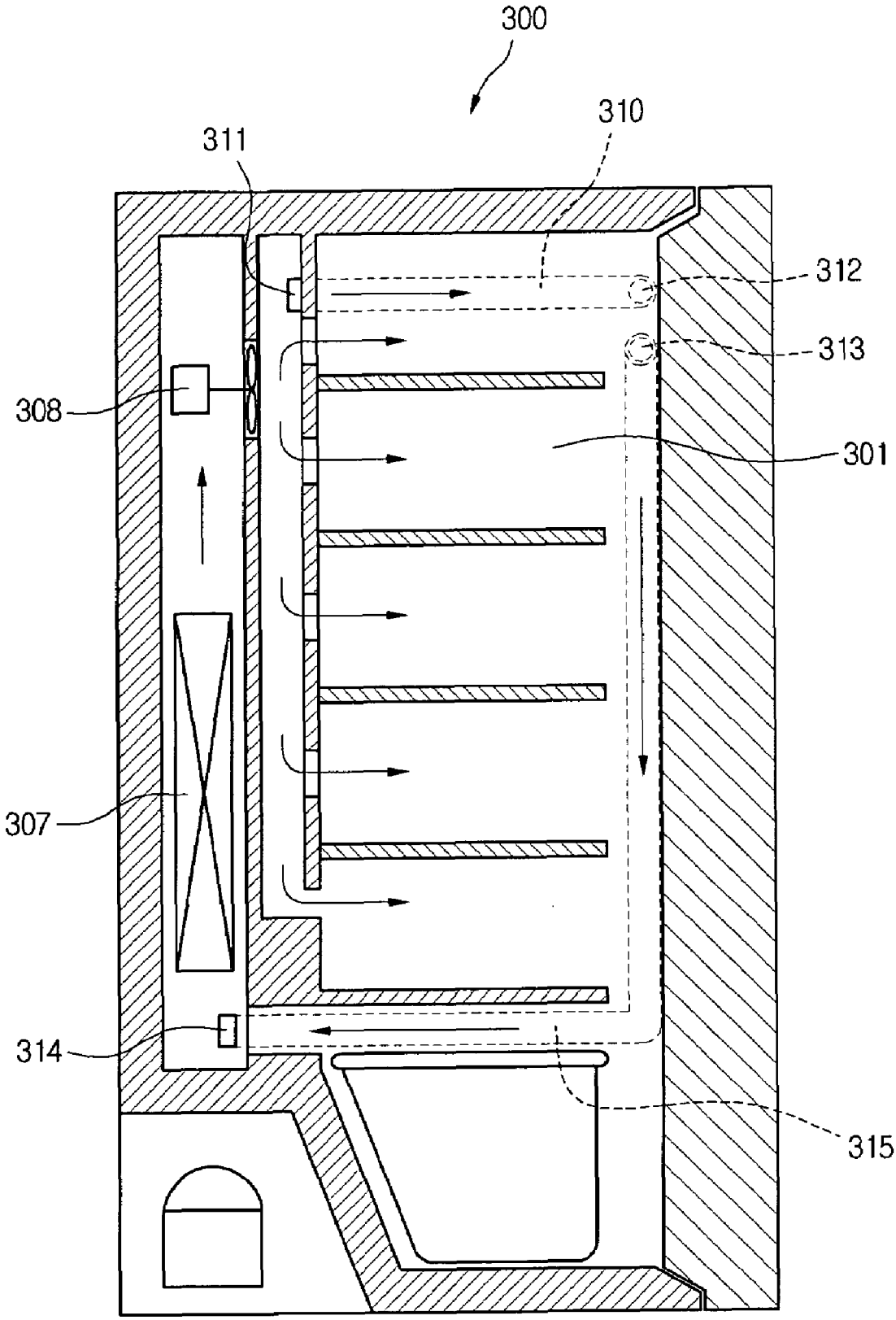
FIG. 6 is a longitudinal sectional view of a barrier portion of a refrigerator according to a second embodiment of the present invention.
Figure 7:
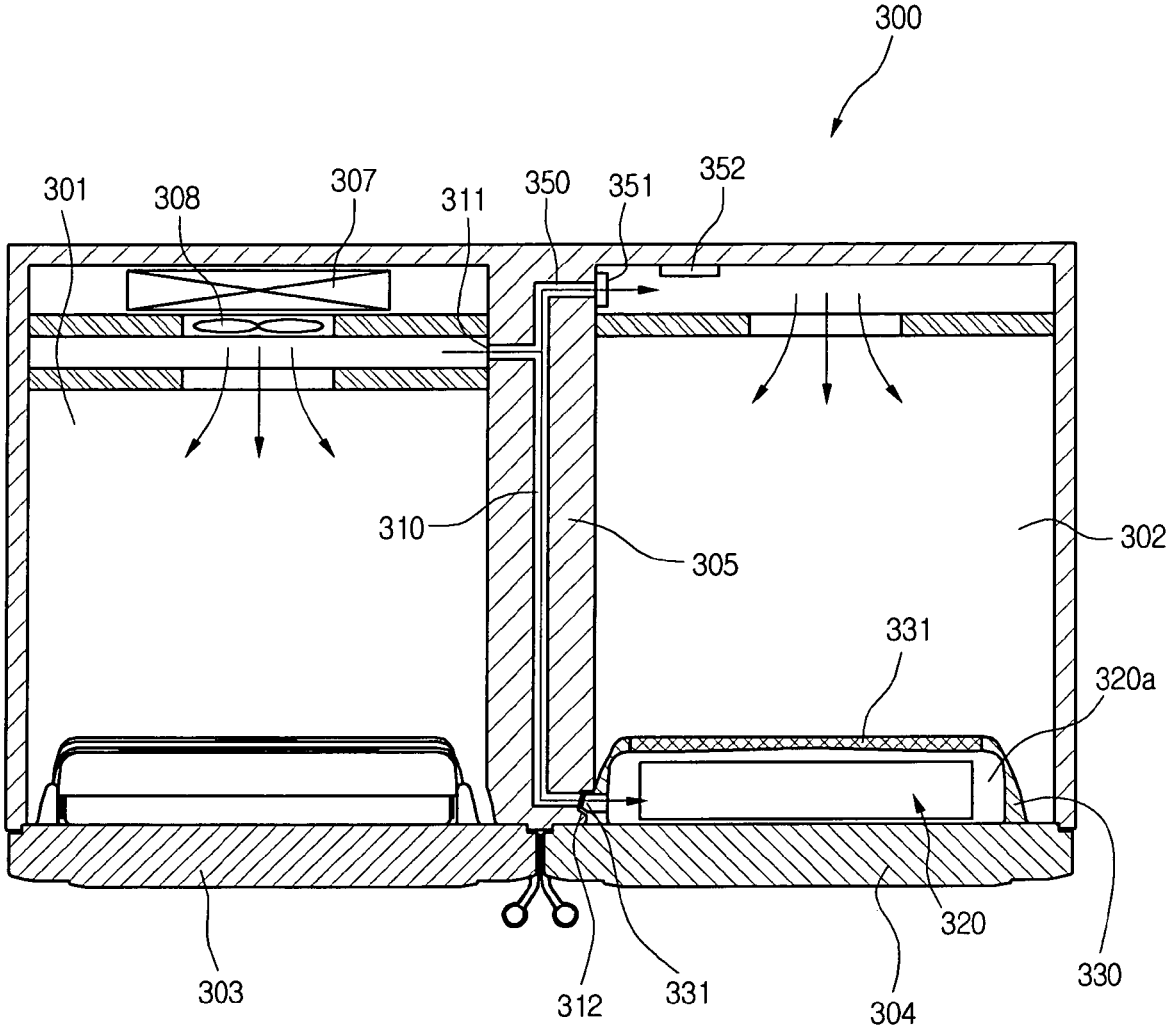
FIG. 7 is a cross-sectional view of an icemaker and an adjacent portion thereof in the refrigerator according to the second embodiment of the present invention.

FIG. 6 is a longitudinal sectional view of a barrier portion of a refrigerator according to a second embodiment of the present invention and FIG. 7 is a cross-sectional view of an icemaker and an adjacent portion thereof in the refrigerator according to the second embodiment of the present invention.

Operation of a refrigerator according to the second embodiment of the present invention will now be described with reference to FIGS. 6 and 7.

Referring to FIGS. 6 and 7, an adiabatic case 330 is installed at a chilling chamber door 304 of a chill chamber 302. An ice machine 320 is installed inside the adiabatic case 330 and an openable and closable adiabatic cover 331 is installed in front of the ice machine 320.

To form a cooling air circulation passage via the ice machine 320, a cooling air supply duct 310 and a cooling air discharge duct 315 are formed inside a barrier 305.

A first cooling air inlet 311 is formed at one end of the cooling air supply duct 310 to communicate with a space where an evaporator 307 and a blower fan 308 are installed, and a first cooling air outlet 311 contacting the adiabatic case 330 is formed at the other end of the cooling air supply duct 310. By the above construction, the cooling air generated in the evaporator 307 is directly supplied to an adiabatic space 320*a* through the barrier 305 without being via the freezing chamber. Also, the cooling air flowing to a cooling air supply duct 350 of the chilling chamber 302 is supplied to the chilling chamber 302 through a cooling air supply damper 351 of the chilling chamber 302 and a cooling air controller 352 of the chilling chamber 302. Alternatively, the cooling air supply damper 351 may be installed at a point where a cooling air supply passage is branched into the cooling air supply duct 350 and the cooling air supply duct 310. The cooling air supply damper 351 can adjust the amount of the cooling air introduced into the chilling chamber 302 and the amount of the cooling air supplied to an ice machine 320.

The cooling air introduced into the adiabatic space 320*a* is supplied to an icemaker of the ice machine 320 and is used as the cooling air for the freezing, and then the cooling air is discharged through the cooling air discharge duct 315 via the third cooling air inlet 313.

The cooling air flowing through the cooling air discharge duct 315 is again introduced into the evaporator 307, is heat-exchanged by the evaporator 307 and the blower fan 308, and is then again circulated.

In a modification of the second embodiment, another cooling air discharge communicating with the freezing chamber may be formed inside the barrier 305, or another cooling air outlet communicating with the chilling chamber may be formed below the adiabatic case 330.

In the second embodiment described above, the cooling air introduction passage is connected to the ice machine through the cooling air supply duct formed inside the barrier and the cooling air discharge passage is connected to the chilling chamber through an opening of the adiabatic case or is directly connected to the evaporator through the cooling air discharge duct inside the barrier. Another cooling air discharge passage is connected to the freezing chamber by penetrating the adiabatic case and the barrier, or is directly connected to the chilling chamber such that the cooling air used in the ice machine is directly discharged to the freezing chamber or the chilling chamber.

In addition, at least one blower fan is installed on the cooling air circulation passage to increase the circulation amount of the cooling air.

Alternatively, in another embodiment, it is possible to form the cooling air supply duct at an inside of an outer wall (right wall, lower wall, or upper wall) of the chilling chamber provided at an inner surface thereof with an adiabatic member not at the inside of the barrier partitioning the inner space of the refrigerator into the freezing chamber and the chilling chamber. By designing the cooling air supply duct as above, it is obvious to those skilled in the art that the design of the cooling air inlet should be changed.

Also, the cooling air discharge passage may be installed in relation to any of the return path of the evaporator, the freezing chamber and the chilling chamber in the aforementioned ice machine.

While the proposed embodiments exemplarily show and describe the side-by-side type refrigerator, it will be apparent that various modifications and variations can be made in the present invention. Thus, it is intended that the present invention covers the modifications and variations of this invention provided they come within the scope of the appended claims and their equivalents.

As described above, according to the refrigerator and cooling air passage structure of the present invention, since an ice machine is installed at a chilling chamber door, it is advantageous that the space of the freezing chamber increases. Also, by installing a cooling air circulation passage for circulating cooling air to the ice machine at the chilling chamber door, it is possible to efficiently control the cooling air used for the freezing.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A refrigerator comprising:

a freezing chamber for storing a product at a temperature below zero;

a chilling chamber for storing a product at a temperature above zero;

a freezing chamber door for opening and closing an entrance of the freezing chamber;

a chilling chamber door for opening and closing an entrance of the chilling chamber;

a barrier for partitioning an inner space of the refrigerator into the freezing chamber and the chilling chamber;

an adiabatic case formed at an inner portion of the chilling chamber door;

an ice machine received in the adiabatic case; and a cooling air supply duct formed at an inside of the barrier and having one end through which a low temperature air is introduced and the other end communicating with an inner space of the adiabatic case.

2. The refrigerator according to claim 1, wherein the one end of the cooling air supply duct communicates with the freezing chamber.

3. The refrigerator according to claim 1, wherein the one end of the cooling air supply duct communicates with an installation space of an evaporator.

4. The refrigerator according to claim 1, further comprising a cooling air discharge duct communicating the inner space of the adiabatic case with the freezing chamber.

5. The refrigerator according to claim 1, wherein the adiabatic case has one end, which is opened and through which the cooling air used for the freezing inside the adiabatic case is discharged to the chilling chamber.

6. The refrigerator according to claim 1, further comprising a cooling air discharge duct communicating the adiabatic case with an installation space of an evaporator.

7. The refrigerator according to claim 1, further comprising a blower fan for blowing cooling air for the freezing to an inside of the adiabatic case or discharging the cooling air used for the freezing to an outside of the adiabatic case.

8. The refrigerator according to claim 7, wherein the barrier is installed in a longitudinal direction of the refrigerator.

9. The refrigerator according to claim 1, wherein a contact surface between the adiabatic case and an introduction/discharge duct is made in an unevenness shape.

10. The refrigerator according to claim 1, further comprising a packing disposed between the adiabatic case and an introduction/discharge duct.

11. The refrigerator according to claim 1, wherein the one end of the cooling air supply duct is branched from a cooling air supply duct of the chilling chamber extending from an evaporator to the chilling chamber.

12. The refrigerator according to claim 1, further comprising an adiabatic cover disposed on an inner surface of the adiabatic case and freely openable and closable.

13. A cooling air passage structure of a refrigerator, comprising:

an adiabatic space formed inside a door of a chilling chamber;

an ice machine disposed inside the adiabatic space; and a refrigerator wall having a first air passage for supplying a cooling air for water freezing to the ice machine.

14. The cooling air passage structure according to claim 13, wherein the refrigerator wall is a barrier for partitioning an inner space of the refrigerator into a freezing chamber and the chilling chamber.

15. The cooling air passage structure according to claim 13, wherein the first air passage has one end communicating with a freezing chamber.

16. The cooling air passage structure according to claim 13, further comprising a second passage communicating an inside of the adiabatic space with a freezing chamber.

17. The cooling air passage structure according to claim 13, further comprising a blower fan for forcibly communicating cooling air between the adiabatic space and the freezing chamber.

18. The cooling air passage structure according to claim 13, further comprising a third passage communicating an inside of the adiabatic space with the chilling chamber.

19. A refrigerator comprising:

a freezing chamber for storing a product at a temperature below zero;

a chilling chamber for storing a product at a temperature above zero;

a freezing chamber door for opening and closing an entrance of the freezing chamber;

a chilling chamber door for opening and closing an entrance of the chilling chamber;

a chilling chamber wall and a freezing chamber wall each including therein an adiabatic member;

an evaporator for generating a cooling air having a temperature below zero using evaporation of refrigerant;

an adiabatic case formed at an inner portion of the chilling chamber door; an ice machine installed in the adiabatic case; and a pair of air passages disposed inside the wall of the refrigerator, each of the pair of air passages having one end communicating with an inside of the adiabatic case and the other end communicating with an installation space of the evaporator.

20. The refrigerator according to claim 19, wherein the outer wall is a barrier for partitioning an inner space of the refrigerator into the freezing chamber and the chilling chamber.

* * * * *